US008418330B2

(12) United States Patent
Muenstermann et al.

(10) Patent No.: US 8,418,330 B2
(45) Date of Patent: Apr. 16, 2013

(54) SUCTION CHAMBER FOR A WATER BAR USED FOR APPLYING JETS TO FABRICS

(75) Inventors: Ullrich Muenstermann, Egelsbach (DE); Andreas Kroll, Darmstadt (DE)

(73) Assignee: Fleissner GmbH, Egelsbach (DE)

( * ) Notice: Subject to any disclaimer, the term of this patent is extended or adjusted under 35 U.S.C. 154(b) by 483 days.

(21) Appl. No.: 12/517,726

(22) PCT Filed: Nov. 17, 2007

(86) PCT No.: PCT/DE2007/002084

§ 371 (c)(1),
(2), (4) Date: Oct. 20, 2010

(87) PCT Pub. No.: WO2008/067790

PCT Pub. Date: Jun. 12, 2008

(65) Prior Publication Data

US 2011/0078883 A1 Apr. 7, 2011

(30) Foreign Application Priority Data

Dec. 4, 2006 (DE) ..... 10 2006 057 367

(51) Int. Cl.
*D04H 1/46* (2012.01)
*D04H 5/02* (2012.01)

(52) U.S. Cl.
USPC ..... 28/104; 28/167

(58) Field of Classification Search ..... 2/104, 105, 2/167; 68/19.1, 19.2, 19, 205 R, 207; 239/418, 239/424, 424.5, 425, 434.5, 549
See application file for complete search history.

(56) References Cited

U.S. PATENT DOCUMENTS 3,508,308 A * 4/1970 Bunting, Jr. et al. ..... 28/104
3,613,999 A * 10/1971 Bentley et al. ..... 239/553.3
4,691,417 A * 9/1987 Vuillaume ..... 28/105
4,984,340 A * 1/1991 Nagatsuka et al. ..... 28/104
(Continued)

FOREIGN PATENT DOCUMENTS

DE 199 23 591 A1 11/2000
DE 10 2006 030 701 A1 3/2007
(Continued)

OTHER PUBLICATIONS

German Office Action dated Aug. 7, 2007 also in English Translation.
(Continued)

*Primary Examiner* — Amy Vanatta
(74) *Attorney, Agent, or Firm* — Venable LLP; Robert Kinberg; Ryan M. Flandro

(57) ABSTRACT

The invention relates to a water bar comprising nozzle parts for a suction chamber to apply jets to fabrics, knitted fabric webs, or nonwoven fabrics copoosed of staple fibers, endless filaments, or cellulose fibers, also in several layers, or mixtures thereof, and a suction area which is located on the bottom side of the suction chamber and is used for sucking off spraying water. The aim of the invention is to largely prevent spraying water or spraying mist in the region of the water jet that is discharged from the water jet beam. Said aim is achieved by assigning an air supplying device to the water bar and/or the suction chamber, said air supplying device being provided with at least one outlet which is located in the region of the water bar and extends to the region of the nozzle ports of the water bar.

31 Claims, 5 Drawing Sheets

U.S. PATENT DOCUMENTS

Figure 1:
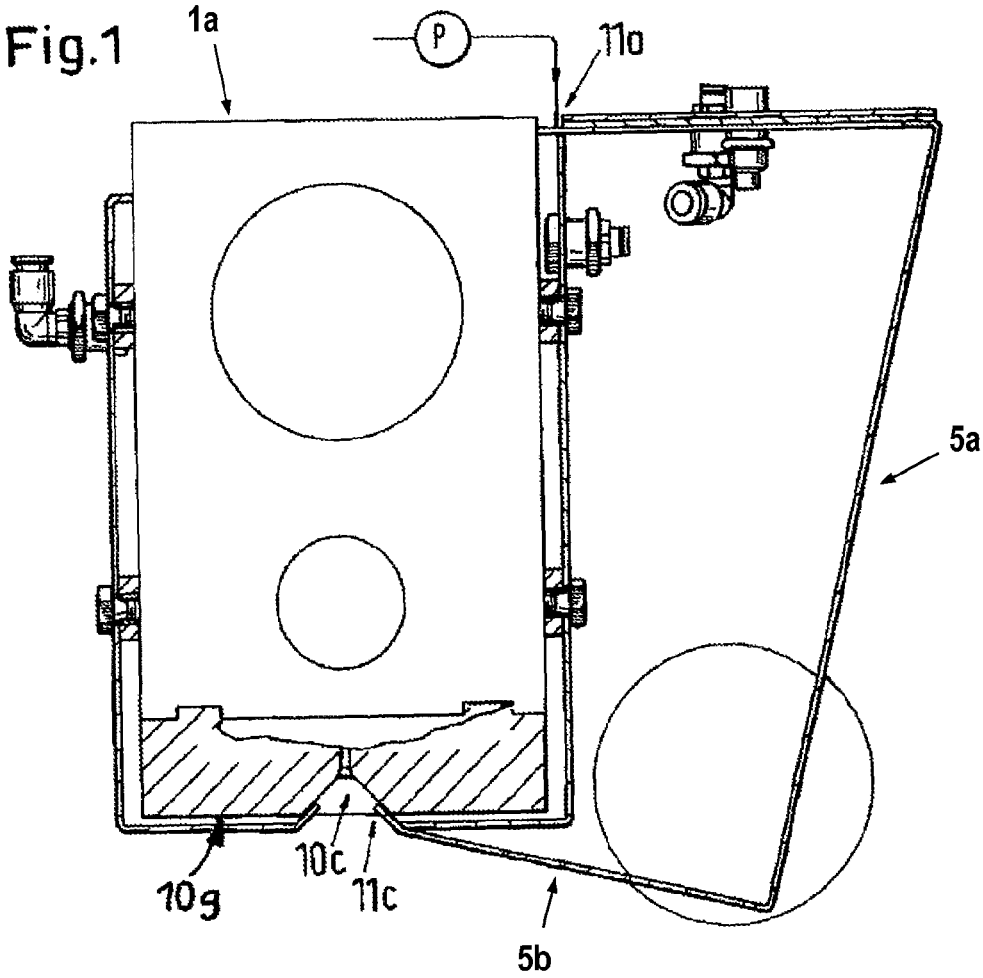

| | | | | |
|---|---|---|---|---|
| 5,964,956 | A * | 10/1999 | Straub et al. | 134/15 |
| 6,203,858 | B1 * | 3/2001 | Plomer | 427/425 |
| 6,457,335 | B1 * | 10/2002 | Fleissner | 68/19.1 |
| 7,022,185 | B2 * | 4/2006 | Nissinen et al. | 118/325 |
| 2007/0051141 | A1 * | 3/2007 | Munstermann | 68/19 |

FOREIGN PATENT DOCUMENTS

| | | | |
|---|---|---|---|
| EP | 1 053 792 | A2 | 11/2000 |
| JP | 04-34057 | | 2/1992 |
| JP | 06-17358 | | 1/1994 |
| WO | WO 01/40562 | A1 | 6/2001 |

OTHER PUBLICATIONS

International Search Report dated Apr. 8, 2008, issued in corresponding International Application No. PCT/DE2007/002084 w/ Engish translation.

* cited by examiner

SUCTION CHAMBER FOR A WATER BAR USED FOR APPLYING JETS TO FABRICS

The invention relates to a water bar for a suction chamber with nozzle openings designed for applying a jet to fabric, knitted fabric webs or nonwoven material consisting of staple fibers, endless filaments or cellulose fibers, also in several layers or mixtures thereof, as well as a suction area on a bottom side of the suction chamber for suctioning off the spraying water.

The process of catching the liquid that splashes against the underside of the water bar is already known (DE 199 23 591 A1). A device is used for this, which is arranged to the side of the water bar and extends along its length. A funnel-type slot is formed onto the edge of the water bar, which is provided on the inside end with a suction slot having a height of approximately 2 mm. If a sufficiently high negative pressure is connected to the otherwise completely enclosed device, all drops including the spray mist can be suctioned off the underside of the water bar, without damage to the needle-punching goods.

Furthermore known for the hydronamic needle-punching of fabrics is a water bar (WO 01/40562 A1) with thereto assigned covered chute, which consists of an upper bracket and an underneath arranged covered chute with porous bottom, so that a suction channel can be formed. A suction intake opening and a horizontal, porous covering plate are arranged for this on one side of the water jet. With this type of arrangement, the respective spraying water can be removed only to an insufficient degree. Also, the resulting spraying water can furthermore not be suctioned off on the side located opposite the water jet.

It is the object of the present invention to design a water bar for applying a water jet to a fabric, knitted fabric web or nonwoven material, such that in particular the spraying water or the spray mist in the area surrounding the water jet that exits the water bar is avoided or can be directed or suctioned off without problem.

This object is solved in that a device for supplying air with the aid of at least one outlet opening is provided, which is assigned to the water bar and the suction chamber in the area of the water bar and which extends into the region of the nozzle openings on the water bar.

Supplying air to the inside region of the nozzle opening prevents the jet of water from spreading out too much and ensures that little spraying water forms on the side of the water jet because the water jet exiting the nozzle opening is directed. The spraying water is furthermore caught with a uniform suction capacity, thus preventing the normally occurring drop forming on the water bar.

For this, the nozzle opening on the water bar is advantageously expanded in the direction of the liquid flow.

It is furthermore advantageous if the nozzle opening consists of one or several segments of respectively different shape.

In addition, the first segment of the nozzle opening advantageously is an elongated segment, which is joined by at least one other, gradually expanding segment.

Furthermore advantageous is the fact that the first segment of the nozzle opening extends along a straight line, at least over a section of the surface area.

Furthermore advantageous is the fact that the first segment of the nozzle opening extends along a straight line, at least over a section of the surface area.

The second segment of the nozzle opening also consists advantageously of a conically expanding segment, for which the angle is smaller than an angle of the third segment for the nozzle opening.

Of particular importance for the present invention is the fact that the conically expanded second segment of the nozzle opening has an angle between 25° and 45° or 30° and 40° and in particular between 33° and 37°, and that the third segment has an angle between 80° and 100° or 85° to 95° and in particular between 88° and 92°.

It is also advantageous that the nozzle opening on the water bar extends approximately over the total length of the water bar with therein embedded nozzle strip provided with numerous openings, wherein the front of the water bar in flow direction forms the outlet side of the funnel-shaped expansion and wherein the length of the third segment, as measured from the outlet side, is equal to or longer than the length of the second segment.

It is furthermore advantageous that the surface of the second or the third segment forms a curve or an arc, at least in a section of the surface area.

It is furthermore advantageous that the outlet opening of the air supply device is embodied flat in the area of its outlet end and extends approximately parallel to the surface of the third or the second segment.

Two or more outlet openings of the air supply device are advantageously arranged opposite each other, are embodied flat in the area of the outlet end, and extend approximately parallel to the surface of the third or the second segment.

The water bar with nozzle openings for a suction chamber, used to apply a jet to fabric, knitted fabric webs or nonwovens that consist of staple fibers, endless filaments, or cellulose fibers, also consisting of several layers or mixtures thereof, is furthermore advantageously provided with a suction area on a lower side of the suction chamber for suctioning off spraying water.

It is also advantageous if the water bar and the suction chamber have a thereto assigned air supply device, which is provided with at least one outlet opening in the region of the water bar, which extends into the region of the nozzle openings or into the nozzle openings of the water bar, wherein at least two outlet openings of the air supply device are arranged opposite each other and are embodied flat on the outlet side end and extend approximately parallel to the surface of the third or the second section. A water bar is thus created in a simple and cost-effective manner, which is nearly drop-free over its complete length, so that no drops marring the optical appearance can fall onto the fabric, a knitted fabric web, or a nonwoven material. The spraying water and the mist, generated by the spraying water, are sucked in with a uniform suctioning power over the total area of a suction device surface, thereby preventing the normally occurring drop forming on the water bar.

It is a further advantageous that an air-displacement body is positioned above the perforated suction area, in particular above the suction area with a relatively large open surface, which delimits the suction area in such a way that it is possible to achieve a maximum air flow of 2 m/s on the outside of the perforated suction area. The air-displacement body is positioned such that a uniform suctioning effect is ensured over the total width and length of the perforated suction area, wherein the air-displacement body and also the outlet openings for the air supply device extend over the total length of the water bar.

Air flows inside the suction chamber are adjusted as needed as a result of the arrangement of the air-displacement body. A special flexibility is achieved if the air-displacement body is mounted so as to be adjustable with respect to height as well as inclination.

According to a different embodiment of the invention, it is advantageous if a lower portion of the air-displacement body in longitudinal direction of the suction chamber encloses an angle with the underside of this chamber of between 1° and 30°, especially between 1° and 5°, wherein the gap between the air-displacement body and the perforated suction area narrows down in the direction of a suctioning device.

It is furthermore advantageous if one end or one side wall of the air-displacement body ends in the region of the suctioning device that is connected to the suction chamber.

It is advantageous if the suction area is positioned at an angle, extending from an upper region near the water bar or a drip edge to a lower region of the suction chamber.

It is furthermore advantageous if the perforated suction area has openings with differently large cross sections.

The cross sections of the openings are furthermore embodied so as to increase in size, starting with the drip edge.

According to a different embodiment of the invention, the opening cross sections advantageously increase continuously or at uniform increments, starting from the drip edge.

Furthermore advantageous is the fact that the spacing between the individual openings can be the same or different.

According to a different feature of the invention, an angle is advantageously formed by a tangential of a screening roller and the perforated suction area, which angle is between 5° and 25°, especially between 6° and 15°, wherein the openings of the suction area on the inside that is facing a water jet form an open area of approximately 3% to 8%, preferably 5% while those on the outside form an open area of approximately 10% to 25% and preferably 20%.

According to a different embodiment of the invention, the air supply device advantageously comprises an air supply channel, formed as a result of the spacing between an outside of the water bar and an outside of the suction chamber that is facing the water bar, at a distance of 1 to 15 mm, preferably 3 to 10 mm and especially 3 and 6 mm.

It is advantageous in this respect that air is supplied to the water jet via the air supply device, wherein a blower is assigned to the air supply device to generate an excess pressure.

An additional option according to one modification of the invention is that the outlet opening is oriented such that the stream of air impacts approximately perpendicular with the water jet exiting the water bar.

Furthermore advantageous is that the air supply device or the air gap is located at least partially between the water bar and the outlet opening of the suction chamber or extends along the outside of the water bar and parallel to the water bar in the region of an underside of the water bar.

It is particularly advantageous if the suction chamber or the suction chamber and the air supply device is or are arranged respectively symmetrical on both sides of the water bar or the water jet.

Also advantageous is the fact that the air supply channel with its outlet opening extends into the funnel-shape expanded nozzle opening and that the air stream exiting the outlet opening flows in the opposite direction as the water jet exiting the nozzle opening.

Furthermore advantageous is the fact that the air supply channel extends into the funnel-shaped expanding nozzle opening and extends approximately parallel to a wall segment of the funnel-shaped expanding nozzle opening and that the air stream flows approximately in the opposite direction as the water jet that exits the nozzle opening.

It is furthermore advantageous that the air stream exiting an outlet opening is deflected via a deflection device, such that it flows approximately in the flow direction of the water jet exiting the nozzle opening, thereby preventing the water jet from spreading out too much.

A further modification of the invention optionally provides that the deflection device is provided in the end region of the outlet opening for the second segment of the nozzle opening or in a region, in which the funnel-shaped expanding segment of the nozzle opening has its smallest cross-sectional dimension.

Further advantages and details of the invention are disclosed and explained in the patent claims and the specification.

Figure 4:
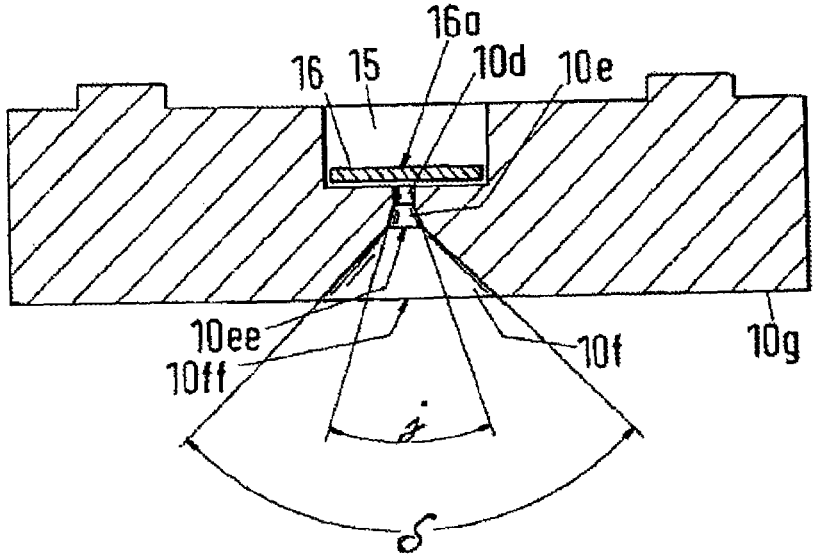
Figure 2:
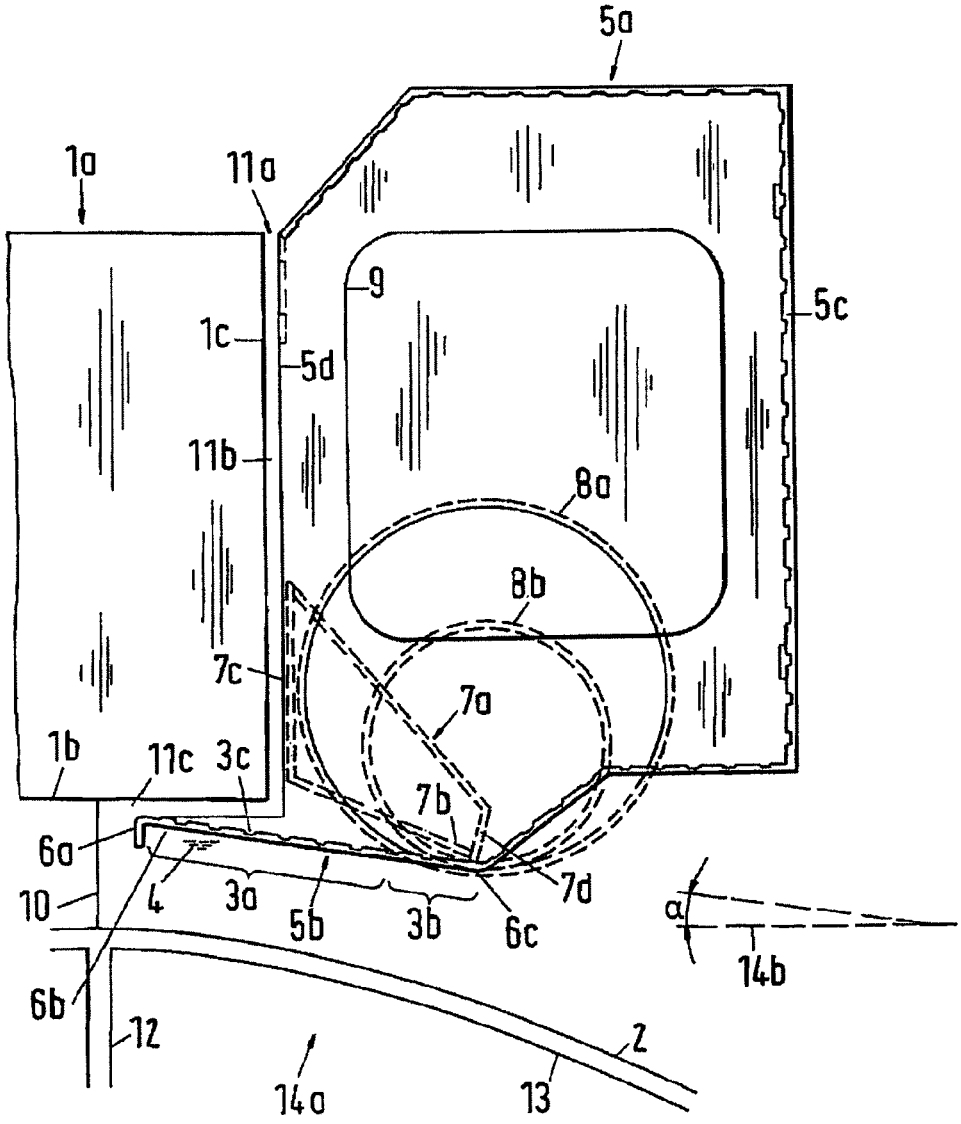
Figure 3:
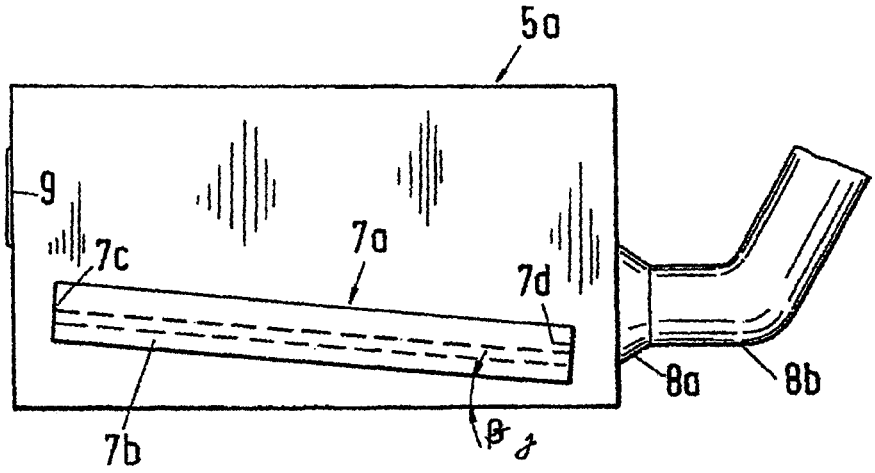
Figure 5:
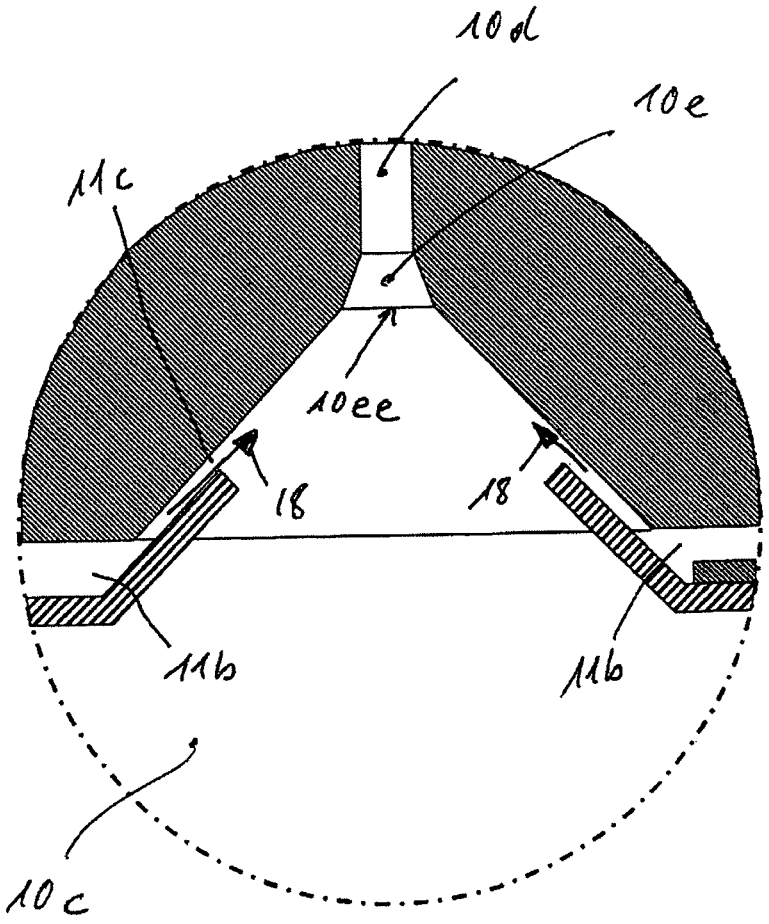
Figure 6:
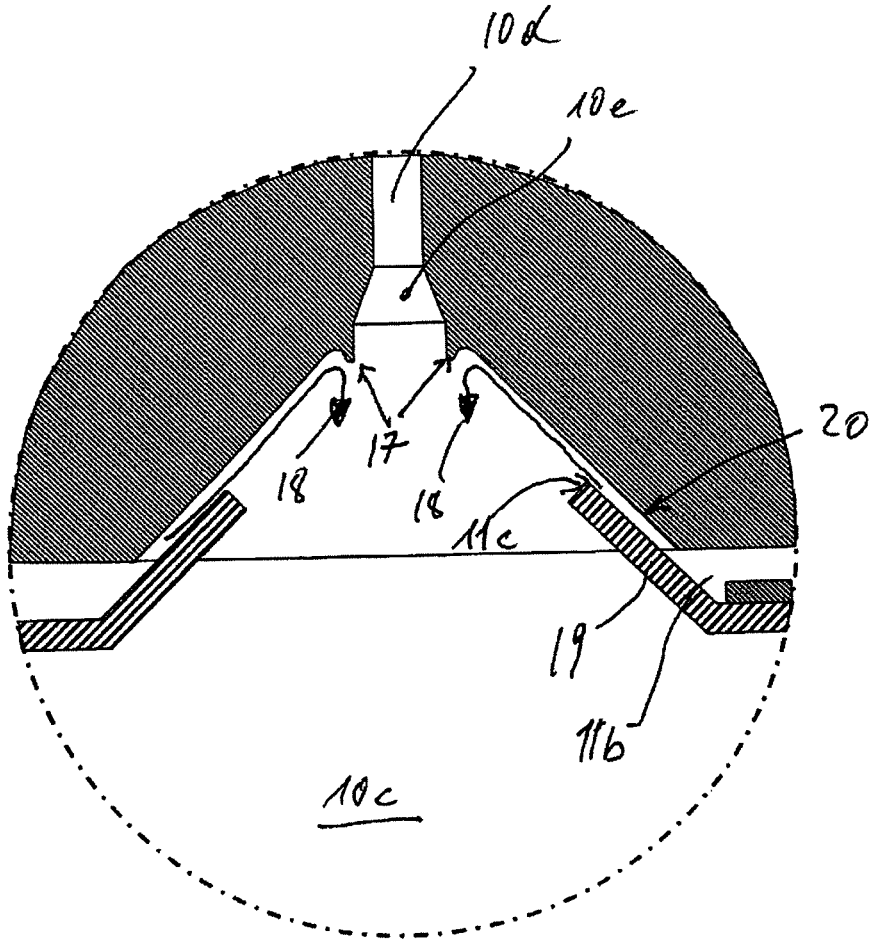

Shown are in:

FIG. 1 A suction chamber for a water bar, used for applying a jet to fabrics, showing a partial sectional view through a suction chamber;

FIG. 2 A different exemplary embodiment of a suction chamber for a water bar with air supply device, provided with an outlet opening that ends in the region of the water bar;

FIG. 3 An air displacement body provided in the suction chamber, which is positioned such that a uniform suctioning effect is ensured over the complete width of the perforated surface or the suction area;

FIG. 4 A sectional view of the water bar shown in FIG. 1 with a funnel-shaped expanding, nozzle opening, which is only partially indicated in FIG. 1;

FIG. 5 A sectional view of the nozzle opening shown in FIG. 1, with a funnel-shaped expanding nozzle opening into which the air channel extends with its outlet opening;

FIG. 6 A sectional view of the water bar shown in FIG. 1 with a funnel-shaped expanding nozzle opening, into which the air supply channel extends with its outlet opening, wherein a protrusion or a deflecting device for the air stream is provided in the second segment;

The reference 1*a* in FIG. 1 refers to a water bar from which a water stream exits via nozzle openings, not shown in the drawing, and is applied to a fabric, a knitted fabric web or a nonwoven 2 (not shown in FIG. 1—see FIG. 2) that is delivered via a supporting surface 13 of a screening drum or screening roller 14*a* (not shown in FIG. 1—see FIG. 2). The water for the most part is discharged via a water discharging device 12 of the screening roller 14*a* (not shown in FIG. 1—see FIG. 2).

The region of the water bar 1*a* contains a suction device or a suction chamber 5*a*, which is provided on the underside 5*b* with a perforated suction area 3*a, b* that is positioned at an angle and comprises openings 3*c* (see FIG. 2), so that the spraying water generated when the water stream 10 comes in contact with the fabric, the knitted fabric web, or the nonwoven 2 (not shown in FIG. 1—see FIG. 2) is conducted to the underside of the suction chamber 5*b* where it is completely suctioned off by the suction chamber 5*a*. As a result, the drops of water normally forming on the underside of the water bar 1*a* can be avoided, so that they no longer drip onto the fabric, the knitted fabric web, or the nonwoven 2.

The suction chamber 5*a* of one exemplary embodiment that is not shown in the drawing is arranged symmetrical on both sides of the water bar 1*a*. The suction chamber 5*a* has a negative pressure that is generated with the aid of a pump, not shown herein, which is connected via a suction hose 8*b* (see FIGS. 2 and 3) to the suction chamber 5*a*.

FIG. 2 shows a different exemplary embodiment of the suction chamber 5*a* for the water bar 1*a*, used to apply a water jet to a fabric, a knitted fabric web, or a nonwoven 2, comprising perforated suction areas 3*a* and 3*b* on the bottom side 5*b* of the suction chamber 5*a* for suctioning off the spraying water 4. The perforated suction area 3*a*, 3*b* is arranged at an angle, such that it extends from an upper region 6*b* near the water bar 1*a* or a drip edge 6*a* to a lower region 6*c* of the suction chamber 5*a*. The first section 3*a* of the perforated suction area forms a relatively small open area while the second section 3*b* of the perforated suction area forms a relatively large open area. According to a variant that is not shown herein, the suction chamber can also be formed without the drip edge.

The openings 3*c* in the perforated suction area have a smaller cross section in segment 3*a* than in the segment 3*b*. In this way, a nearly identical suction pressure is generated on the upper inside of the suction area 3*a* or 3*b*, which permits suctioning off the spraying water hitting the fabric, knitted fabric web or nonwoven 2 without problem. Water drops traveling downward as a result of gravity can furthermore be suctioned off completely through the openings 3*c* in the lower region of the suction area 6*c* and into the suction chamber 5*a*.

The spacing between the individual openings 3*c* can be the same or different. Starting from the drip edge 6*a*, the cross sections of the openings 3*c* increase progressively in the direction of the suction chamber 5*a* or a side 5*c* of the suction chamber 5*a* that is facing the water bar 1*a*. However, the cross sections of the openings 3*c*, starting with the drip edge 6*a*, can also increase continuously or by uniform increments.

As shown with the second embodiment in FIG. 2, a tangential 14*b* rests against the outer periphery of the screening roller 14*a*. The tangential 14*b* encloses an angle with the lower surface of the suction area 3*a* and 3*b*, wherein this angle can be between 5° and 25°, but is preferably between 6° and 15°. The open area formed by the openings 3*c* of the suction area 3*a*, 3*b* on the inside 5*d* that is facing the water jet 10 emitted by the water bar 1*a* amounts to approximately 3% to 8%, preferably 5%, while the open area formed by the opening outside amounts to approximately 10% to 25%, preferably 20% (approximately 20%). According to FIG. 2, the suction chamber 5*a* is located on the right side of the water bar 1*a* and is embodied as a nearly rectangular box, which can take up the spraying water 4.

FIG. 2 shows that an air supply device 11*a* is assigned to the water bar 1*a* and the suction chamber 5*a*, which comprises an air supply channel 11*b* that ends in the region of a lower side 1*b* of the water bar 1*a*, wherein one outlet opening 11*c* of the air supply channel 11*b* is located near the water jet 10. The air supply channel 11*b* is essentially formed by an outside 1*c* of the water bar, and a left, continuous and closed outside area 5*d* of the suction chamber 5*a*. The air supply channel 11*b* in this case extends approximately parallel to the outside of the water bar 1*a* and the lower side 1*b* of the water bar 1*a*. The drip edge 6*a* that belongs to the suction chamber 5*a* is also located in the region for the outlet opening 11*c* of the air supply channel 11*b*. Along the drip edge 6*a*, only extremely fine water drops can form that cannot do additional damage when they drop down.

The dry air supplied via the air supply channel 11*b* of the air supply device 11*a* to the water jet 10 has the advantage of not influencing the direction of the water jet 10. The water jet 10 thus is not influenced by minute water drops or water vapor and can be directed with particular focus onto the fabric, the knitted fabric web or the nonwoven 2. For the exemplary embodiment according to FIG. 2, the dry air is supplied via the air supply channel 11*b* to the water jet 10 as a result of an intrinsic suction effect.

According to a different exemplary embodiment that is not shown in the drawing, the dry air can also be actively guided via the air supply device 11*a* to the water jet 10, if necessary with the aid of a blower.

In FIG. 2, the air supply device 11*a* and the suction chamber 5*a* are shown only on the right side of the water bar 1*a*. According to a different embodiment, not shown in the drawing, the suction chamber 5*a* can also be arranged symmetrical on both sides of the water bar 1*a* (see FIG. 1). The air supply device 11*a* can furthermore be arranged symmetrical on both sides of the water bar 1*a*.

A different exemplary embodiment shows a cross section through the water bar 1*a* with a nozzle strip 16 that is positioned in a rectangular recess 15 and contains numerous openings in the form of small bore holes, arranged in a row, which have a diameter size ranging from 0.1 to 0.15 mm that permits water to reach the elongated nozzle opening 10*c*.

The lower section 1*d* of the water bar shown in FIG. 4 contains an elongated nozzle opening 10*c* extending over nearly its complete length, which has a thereto assigned air supply device 11*a* shown in FIG. 1 and is provided with at least one outlet opening 11*c* in the region of the water bar 1*a* and extends all the way into the front, center, or rear region of the nozzle openings 10*c* in the water bar 1*a*.

The nozzle opening 10*c* in the water bar 1*a* expands in movement direction of the liquid, meaning in the direction toward the front. The nozzle opening 10*c* consist of one or several segments 10*d*, 10*e*, 10*f*, which can respectively have different shapes.

The first segment 10*d* of the nozzle opening 10*c* is an elongated segment that extends in the image plane, which is adjoined by at least one additional, gradually expanding segment 10*e* that extends in the image plane, which in turn is followed by a similar, gradually expanding segment 10*f*. The length of the three segments corresponds to the length of the nozzle opening 10*c*.

With reference to FIG. 4, the dimensions for the first segment 10*d* of the nozzle opening 10*c* are smaller than the dimensions for an outlet opening 10*ee*, 10*ff* of the following second and third segment. The segments 10*d*, 10*e*, 10*f* are slot-shaped, as previously mentioned, and are located below the nozzle strip 16 provided with numerous openings or bore holes 16*a*, as shown in FIG. 4. The length of the nozzle opening 10*c* therefore approximately equals the length of the row of successively arranged bore holes 16*a*.

The cross sectional surface of the air supply device 11*a*, respectively the air supply channel 11*b*, ranges from 3 to 15 mm, preferably from 5 to 10 mm and in particular from 7 to 8 mm.

The second and third segments 10*e*, 10*f* of the nozzle opening 10*c* gradually expand conically. The angle for the second segment 10*e* is smaller than the angle β of the following third segment 10*f* of the nozzle opening 10*c*.

The conically expanding second segment 10*e* of the nozzle opening 10*c* has an angle between 25° and 45° or 30° and 40° and especially between 33° and 37°. The third segment 10*f* has an angle β between 80° and 100° or 85° and 95°, in particular between 88° and 92°.

The surface of the second segment 10*e* or the third segment 10*f* takes the form of a curve or an arc, at least over a limited surface region.

A front side of the water bar 1*a* as seen in flow direction functions as outlet side 10*g* for the funnel-shaped expansion. The length of the third segment 10*f*, as measured from the outlet side 10*g*, is equal to or longer than the length of the second segment 10*e*.

The air supply channel 11*b* of the air supply device 11*a* for the exemplary embodiment according to FIG. 2 is essentially formed by having a spacing of 1 to 15 mm, preferably of 3 to 10 mm and in particular of 3 to 6 mm, between the outside 1*c* of the water bar and the outside 5*d* that is facing the water bar of the suction chamber. The air supply channel 11*b* can also be embodied with hoses or similar air supply devices for a variant that is not shown in the drawing.

The outlet opening 11*c* extends approximately over the total width of the water bar 1*a* and is oriented such that the exiting stream of air impacts approximately perpendicular with the water jet 10 leaving the water bar 1*a*.

It is particularly advantageous, even according to the second embodiments mentioned herein and shown in FIG. 4, if the outlet opening 11*c* is oriented such that the exiting air stream moves approximately parallel to the surface of the third segment 10*f* or the second segment 10*e*. The water jet is thus prevented from expanding too much and it is ensured that little spraying water is formed on the side of the water jet because the water jet remains directed.

According to FIG. 2, the openings 3*c* in the perforated suction area on the side 3*a* that is facing the water jet 10 can be embodied as elongated, approximately parallel extending slots, having a length between 1 mm and 10 mm and a width A of between 0.1 mm and 3 mm. The slots provided on the outside 3*b* of the perforated suction area advantageously can be embodied with an angled shape, having a length between 1 mm and 10 mm and a width B between 0.1 mm and 3 mm. Depending on the exemplary embodiment, the slots can also take the form of a line or can be wavy. All of these embodiment variants for the openings 3*c* are intended to suction in as efficiently as possible the drops formed by the spraying water 4 that flow along the perforated suction area. In particular, the goal is to prevent the spraying water 4 drops from flowing between the openings 3*c*.

According to a different exemplary embodiment shown in FIGS. 2 and 3, an air-displacement body 7*a* can be arranged in the suction chamber 5*a*, which can have different shapes. The air-displacement body 7*a* according to FIGS. 2 and 3 is a hollow body delimited by two parallel-extending side walls 7*c* and 7*d*. In the region of the suction area 3*a* and 3*b*, a lower side 7*b* of the displacement body 7*a* extends approximately parallel to the inside surface of the perforated suctions area 3*a*, 3*b*. A small gap measuring from 2 mm to 10 mm exists between the underside 7*b* of the displacement body 7*a* and the inside surface of the suction area 3*a* and 3*b*, which gap ensures that a uniform suction pressure is achieved for the complete suction area. The air displacement body 7*a* is located above the perforated suction area 3*a*, 3*b*, in particular above the suction area with relatively large open area 3*b*, so that the perforated suction area 3*a*, 3*b* is restricted, for example such that a maximum air stream of 2 m/s flows on the outside of the perforated suction area 3*b*.

The air-displacement body 7*a* advantageously extends over the total width and length of the suction chamber 5*a*. To achieve the highest possible flexibility when adjusting the air flows within the suction chamber 5*a*, the air-displacement body 7*a* according to a different advantageous embodiment that is not shown in the drawings can be mounted so as to be adjustable with respect to height and inclination.

FIG. 2 shows that the underside 7*b* of the displacement body 7*a* extends in the same direction as the suction area 3*a* and 3*b*, thereby enclosing an angle between 5° and 30°, which is not shown in the drawing. FIG. 3 furthermore shows that the air-displacement body can also enclose an angle β with its bottom side 7*b* and the inside surface of the perforated suction area 3*a*, 3*b*, wherein this angle is between 1° and 30°, respectively between 1° and 5°, wherein the gap between the air-displacement body 7*a* and the perforated suction area 3*a*, 3*b* becomes smaller in the direction of the suction device 8*a*. A suction device, consisting of the connecting sleeve 8*a* and the suction hose 8*b* is located on the back side of the suction chamber 5*a* and functions to discharge the spraying water absorbed by the suction chamber 5*a* and to generate the negative pressure in same. The inside space of the suction chamber 5*a* is accessible via a supply flap 9.

As can be seen in FIG. 3, the lower end of the air-displacement body 7*a* is advantageously positioned in the region of the connecting sleeve for the suction device 8*a*.

According to a different embodiment shown in FIG. 5, the air supply channel 11*b* extends into the funnel-type expanded nozzle opening 10*c* and furthermore extends approximately parallel to a portion of the wall of the funnel-type expanding nozzle opening 10*c*, approximately in the direction opposite the flow direction for the water jet exiting the nozzle opening 10*c*.

According to FIG. 6, the air stream exiting through the outlet opening 11*c* can furthermore be deflected via a deflection device 17, far enough so that it extends approximately in flow direction of the water jet exiting the nozzle opening 10*c*.

The deflection device 17 can furthermore be installed in the end region of the outlet opening 10*ee* for the second segment 10*e* of the nozzle opening 10*c*, or in a region where the funnel-type expanding portion of the nozzle opening 10*c* has its smallest cross section.

REFERENCE NUMBER LIST

1*a* water bar
1*b* lower side of the water bar
1*c* outside of the water bar
1*d* lower portion of the water bar
2 fabric, knitted fabric web, nonwoven
3*a* perforated suction area, relatively small open surface
3*b* perforated suction area, relatively large open surface
3*c* opening
4 spraying water
5*a* suction chamber
5*b* lower side of the suction chamber
5*c* side of suction chamber that is facing away from the water bar
5*d* side of suction chamber that is facing toward the water bar
6*a* drip edge
6*b* upper region of the suction area or the suction chamber
6*c* lower region of the suction area or the suction chamber
7*a* air-displacement body
7*b* lower side of the displacement body
7*c* side wall of the displacement body
7*d* side wall of the displacement body
8*a* suction device, connecting sleeve
8*b* suction device, suction hose
9 supply flap
10 water jet
10*c* nozzle opening
10*d* first segment
10*e* second segment
10*f* third segment
10*g* outlet side, lower portion
10*ee* outlet opening
10*ff* outlet opening
11*a* air supply device; air gap
11*b* air supply channel
11*c* outlet opening
12 water discharge device
13 fabric support
14*a* screening roller
14*b* tangential
15 recess
16 nozzle strip
16*a* opening; bore hole
17 deflection device

18 air stream; air flow
19 wall
20 wall
α angle
β angle
γ angle
σ angle
A width
B width

The invention claimed is:

1. A device for applying a jet of water to fabric, knitted fabric webs, or nonwovens, wherein the fabric, knitted fabric webs, or nonwovens comprise layers of staple fibers, endless filaments, or cellulose fibers or mixtures thereof, the device comprising:

a water bar having a nozzle opening;

a suction chamber including a suction area on a lower side of the suction chamber for suctioning off water spraying from the jet of water; and an air supply device assigned to the water bar and the suction chamber, the air supply device having at least one outlet opening located in the region of the water bar and extending into the nozzle opening.

2. The device according to claim 1, wherein the nozzle opening of the water bar expands in liquid movement direction.

3. The device according to claim 1, wherein the nozzle opening comprises one or more segments, respectively having different shapes.

4. The device according to claim 1, wherein a first segment of the nozzle opening is an elongated segment, which is adjoined by at least one other, gradually expanding second segment.

5. The device according to claim 1, wherein a first segment of the nozzle opening extends along a straight line, at least in one section of the surface.

6. The device according to claim 1, wherein a first segment of the nozzle opening is an elongated segment having smaller dimensions than outlet openings of following second and third segments.

7. The device according to claim 6, wherein the second segment of the nozzle opening is a conically expanding segment for which an angle (α) is smaller than an angle (β) of the third segment for the nozzle opening.

8. The device according to claim 7, wherein the angle (α) of the conically expanding second segment for the nozzle opening measures between 25° and 45°, and wherein the angle (β) of the third segment measures between 80° and 100°.

9. The device according to claim 6, wherein the nozzle opening in the water bar extends approximately over the total length of the water bar with therein embedded nozzle strip provided with numerous openings, wherein a front side of the water bar that is positioned in flow direction forms an outlet side of a funnel-type expansion and a length of the third segment, as measured from the outlet side, is equal to or longer than a length of the second segment.

10. The device according to claim 6, wherein a surface of the second segment and the third segment forms a curve or an arc, at least in a section of the surface.

11. The device according to claim 6, wherein the outlet opening of the air supply device is embodied flat in a region of a discharge end and extends approximately parallel to a surface of the third segment or the second segment.

12. The device according to claim 6, wherein two or more outlet openings for the air supply device are arranged opposite each other and are embodied flat in a region of a discharge end and extend approximately parallel to a surface of the third segment or the second segment.

13. The device according to claim 1, wherein the suction area is perforated, the device further comprising an air displacement body positioned above the perforated suction area with a relatively large open area, wherein the air displacement body restricts the perforated suction area in such a way that a maximum air stream of 0.5 m/s to 5 m/s is achieved on an outside of the perforated suction area, wherein the air displacement body is positioned such that a uniform suction effect is ensured over the total width and length of the perforated suction area, and wherein the air displacement body and at least one outlet opening of the air supply device extend over a complete length of the water bar.

14. The device according to claim 13, wherein the air displacement body has a lower side, which encloses in a longitudinal direction of the suction chamber with its underside an angle (β) that ranges from 1° to 30°, wherein a gap between the air displacement body and the perforated suction area becomes smaller in a direction of a suction device.

15. The device according to claim 14, wherein the air displacement body ends with one of its ends or with a side wall in a region of the suction device that is connected to the suction chamber.

16. The device according to claim 1, wherein the suction area is positioned at an angle and extends from an upper region near the water bar or a drip edge to a lower region of the suction chamber.

17. The device according to claim 16, wherein the suction area comprises first and second perforated segments, the first segment having openings with differently cross sections than the second segment.

18. The device according to claim 16, wherein a cross section for openings in the suction area become increasingly larger, starting with the drip edge.

19. The device according to claim 16, wherein a cross section for openings in the suction area increase in size either continuously or in steps, starting with the drip edge.

20. The device according to claim 16, wherein a distance between individual openings is the same or different.

21. The device according to claim 16, wherein the suction area is perforated by openings and an angle (α) is formed with a tangential of a screening roller and the perforated suction area, which angle is between 5° and 25°, wherein the openings of the suction area on an inside that is facing a water jet form an open surface of approximately 3% to 8% and on an outside form an open surface of 10% to 25%.

22. The device according to claim 16, wherein the air supply device has an air supply channel, formed by a gap of 1 to 15 mm between an outside of the water bar and an outside of the suction chamber that is facing the water bar.

23. The device according to claim 16, wherein air is supplied to the water jet via the air supply device, wherein a blower is assigned to the air supply device for generating an excess pressure.

24. The device according to claim 16, wherein the outlet opening is oriented such that the air stream impacts approximately perpendicular with the water jet exiting the water bar.

25. The device according to claim 22, wherein the air supply device or the air supply channel is provided at least partially between the water bar and the outlet opening of the suction chamber or is guided along the outside of the water bar and extends parallel thereto in the region of a lower side of the water bar.

26. The device according to claim 16, wherein the suction chamber or the air supply device is or are respectively arranged symmetrical on both sides of the water bar or the water jet.

27. The device according to claim 22, wherein the outlet opening of the air supply channel extends into the nozzle opening, wherein the nozzle opening is a funnel-shaped expanding nozzle opening, and wherein the air stream exiting the outlet opening flows counter to a flow direction for the water jet leaving the nozzle opening.

28. The device according to claim 1, wherein an air supply channel extends into the nozzle opening and extends approximately parallel to a portion of a wall of the nozzle opening, wherein the nozzle opening is a funnel-shaped expanding nozzle opening, and wherein the air stream flows approximately in an opposite direction to a flow direction for the water jet exiting the nozzle opening.

29. The device according to claim 1, wherein the air stream exiting the outlet opening is deflected via a deflection device approximately in a flow direction of the water jet leaving the nozzle opening.

30. The device according to claim 6, wherein a deflection device is provided in the region of an outlet end of the outlet opening of the second segment of the nozzle opening or in a region where a funnel-shaped expanding portion of the nozzle opening has approximately the smallest cross section.

31. A device for applying a jet of water to fabric, knitted fabric webs, or nonwovens, wherein the fabric, knitted fabric webs, or nonwovens comprise layers of staple fibers, endless filaments, or cellulose fibers or mixtures thereof, the device comprising:

a water bar having a nozzle opening comprising first, second and third segments;

a suction chamber including a suction area on a lower side of the suction chamber for suctioning off water spraying from the jet of water; and an air supply device assigned to the water bar and the suction chamber, wherein the air supply device includes at least one outlet opening in a region of an outlet end of the water bar and extending into the region or into the nozzle opening of the water bar, wherein at least two of the outlet openings of the air supply device are arranged opposite each other and are embodied flat in the region of the outlet end and extend approximately parallel to a surface of the third segment or the second segment.

* * * * *